United States Patent [19]

Begin

[11] 4,311,452

[45] Jan. 19, 1982

[54] HIGH STABILITY GAS/ELECTRIC PILOT-IGNITOR

[75] Inventor: Pierre Begin, Boisbriand, Canada

[73] Assignee: CEA of Canada, Ltd., Montreal, Canada

[21] Appl. No.: 118,561

[22] Filed: Feb. 4, 1980

[51] Int. Cl.[3] ..... F23D 15/02

[52] U.S. Cl. ..... 431/352; 431/347

[58] Field of Search ..... 431/351, 352, 347, 10

[56] References Cited

U.S. PATENT DOCUMENTS

| | | | |
|---|---|---|---|
| 2,072,731 | 3/1937 | Crosby | 431/352 X |
| 2,398,654 | 4/1946 | Lubbock et al. | 431/352 X |
| 2,538,953 | 1/1951 | Yates et al. | 431/352 X |
| 3,368,604 | 2/1968 | Mutchler | 431/352 X |
| 3,531,230 | 9/1970 | Apolinarski | 431/352 |
| 3,881,863 | 5/1975 | Creuz | 431/352 X |
| 4,203,719 | 5/1980 | Brandt | 431/352 |

FOREIGN PATENT DOCUMENTS

| | | | |
|---|---|---|---|
| 746061 | 5/1933 | France | 431/351 |

*Primary Examiner*—Edward G. Favors

*Attorney, Agent, or Firm*—Rummler & Snow

[57] ABSTRACT

A pilot for a 1 to 2 million btu/hr. gas burning ignitor having a chamber for mixing gas and air in combustible proportions with an annular flame retaining and stabilizing device at its outlet. This device comprises two conical surfaces configured together in back-to-back relation within a cylindrical shroud, one a converging inlet to a restricted flow area and the other a diffusing outlet surface therefrom with a sharp circumferential lip inbetween. A distribution head at the inlet to the mixing chamber directs jets of gas at the lip of said cones which aspirate turbulent air through ports in the wall of the chamber. A high voltage elecrode ignites the gas/air mixture at the cone lip. A ported extension of the mixing chamber downstream of the stabilizing device contains the pilot flame and shrouds additional aspirated air for control of secondary combustion in the pilot.

19 Claims, 8 Drawing Figures

HIGH STABILITY GAS/ELECTRIC PILOT-IGNITOR

BACKGROUND OF THE INVENTION

In the design of gas/electric pilots for gas burning ignitors which premix a combustible mixture of gas and air before burning, a bluff object placed in the mixture at the edge of the flame front, as set forth in Canadian Pat. No. 925,426 to Vignes, stabilizes the flame at that location if operating conditions and mixture ratio are carefully controlled. Bluff-body flame stabilization has not proven entirely satisfactory for present industrial gas burner applications requiring ignitors with capacities of 1 to 2 million btu/hr. using a variety of different gases with compressed or windbox air over a wide range of mixture ratios. One of the reasons for this ignitor instability is that pilot flame is not present in the ignitor all the time.

There is thus an established need for a gas/electric pilot for gas burning ignitors in which the pilot stays lit all the time and gives stable ignition over a capacity from 1 to 2 million btu/hr. and a wide range of mixture ratios using many different gases with compressed or windbox atmospheric air in combustible proportions.

SUMMARY OF THE INVENTION

The gist of this invention lies in a gas/electric pilot for mounting within the carrier frame of a gas burning ignitor having a cylindrical chamber for mixing gas and air in combustible proportions which is in fluid communication with sources of pressurized gas and atmospheric air. Jets of gas axially emanate from a plurality of nozzles arranged in circular cored array about a distribution head at one end of the chamber and aspirate turbulent air from the surrounding gas burning ignitor through ports in the wall of the pilot chamber for mixing with the gas. An annular flame retaining and stabilizing device lies at the other end of the mixing chamber in the central core of the jets. A ported extension of the mixing chamber downstream of the stabilizing device contains the pilot flame and shrouds additional aspirated air for control of secondary combustion in the pilot.

The annular flame retaining and stabilizing device for the pilot comprises two conical surfaces configured together as a body in back-to-back relation within the cylindrical mixing chamber and shroud, one a converging inlet to a restricted flow area and the other a diffusing outlet therefrom with a sharp circumferential lip inbetween. A stem mounting from the gas distribution head and extending through said central core of the jets supports and heat conductively connects to said body as a heat sink. The lip is in heat conduction relation with said body which is cooled by the scrubbing action of cool turbulent mixing jets of gas therearound. Access through the wall of said shroud allows for the introduction of an electrode and ignition of the pilot flame at the lip of the cones.

An alternative pilot flame retention and stabilizing device provides for similar inlet and outlet to a restricted flow area having in addition a sharp lip in heat conduction relation with the outer cylindrical wall of the mixing chamber as a heat sink therebetween. Still another device uses sharp convoluted lips on both inbetween.

THE PREFERRED EMBODIMENT

Figure 1:
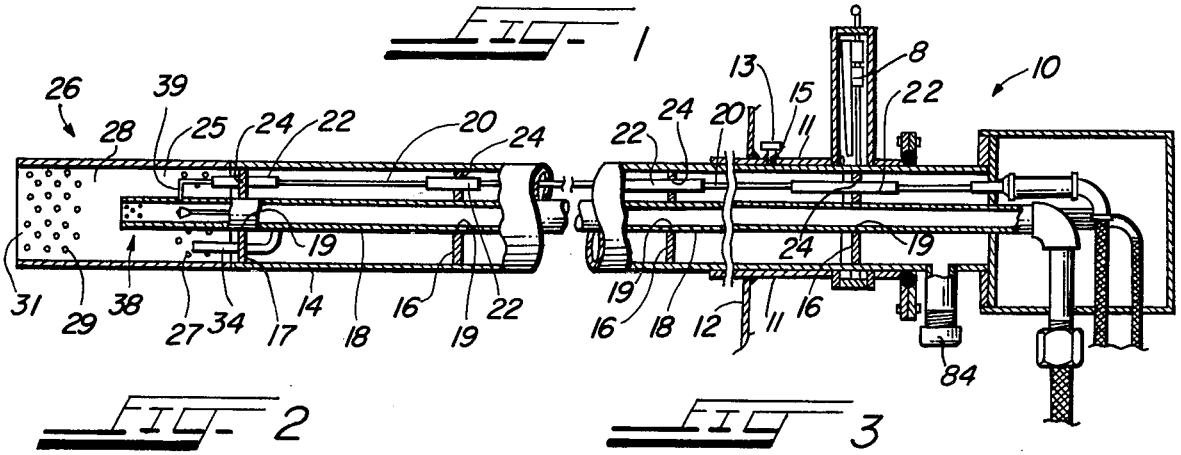
FIG. 1 shows a fragmentary cross-sectional side view of the gas/electric pilot for a gas burning ignitor.
Figure 2:
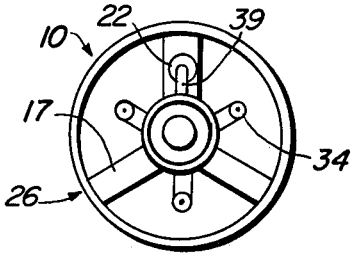
FIG. 2 shows an end view of FIG. 1.

Referring to FIGS. 1 and 2, gas burning ignitor 10 comprises a flanged mounting sleeve 11 which mounts on a burner mounting plate 12 and extends outwardly therefrom for slidingly supporting a carrier pipe 14 therealong. A hexhead machine screw 13 threadedly engages a boss 15 mounted on the outer surface of the sleeve 11 to set the longitudinal location of pipe 14 in sleeve 11. Support and air distribution control legs 16 mount inside pipe 14 at spaced intervals therealong. End support and air distribution control legs 17 mount in the extension end of pipe 14. A gas supply pipe 18 centrally mounts in pipe 14 through aligned apertures 19 on the support and air distribution control legs 16 and 17, respectively, and connects at its inlet end to a source of combustible gas (not shown). An electrical conductor 20 mounts in pipe 14 in offset aligned relation to the axis of pipe 14 on porcelain insulators 22 which insert in apertures 24 on internal and end support and air distribution control legs 16 and 17, respectively. Conductor 20 connects to an electrical source (not shown) at the flanged mounting sleeve 11 on said carrier pipe 14.

A cylindrical head 26 of gas burning ignitor 10 mounts on and extends from the end of the carrier pipe 14 in concentric relation therewith having a mixing chamber 25 comprising a plurality of primary ports 27 exposed to atmospheric air which are circumferentially spaced in the wall of ignitor head 26 around the mixing chamber 25 thereof adjacent to end support and air distribution control legs 17 in pipe 14. Three gas burning ignitor nozzles 34 fluid communicate with gas pipe 18 at locations back of end support and air distribution control legs 17 in pipe 14 and mount therethrough in equi-angularly spaced relation around the axis of pipe 14. Nozzles 34 discharge gas in the axial direction relative thereto into the mixing chamber 25 of ignitor head 26 adjacent to air ports 27 in the wall of the same. A secondary combustion control shroud 28 mounts on and extends from and in fluid communication with the ignitor head 26 in concentric relation with the same. Shroud 28 has an open end 31 and a plurality of secondary ports 29 in the wall thereof exposed to atmospheric air and circumferentially spaced around the same adjacent to the open end 31 thereof. A gas/electric pilot 38 having an electrode 39 being an extension of electrode 20 in carrier pipe 14 mounts in the open end 31 of the shroud extension 28 in the gas burning ignitor head 26.

Figure 3:
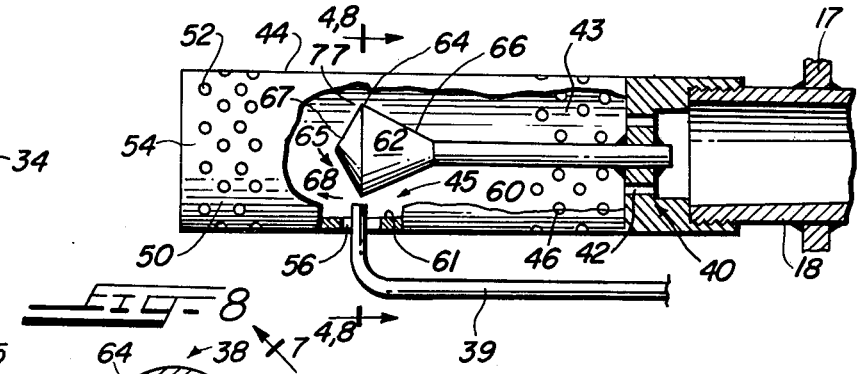
FIG. 3 shows an enlarged, fragmented cross-sectional side view of the pilot of FIG. 1.
Figure 4:
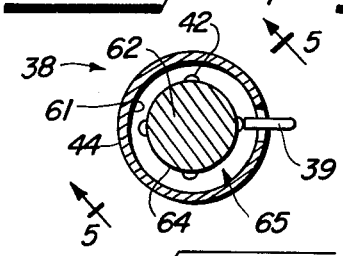
FIG. 4 shows an end view of FIG. 3.

Referring to FIGS. 3 and 4, the preferred embodiment of the gas/electric pilot 38 comprises a cylindrical gas distribution head 40 threaded on gas carrier pipe 18 of gas burner carrier pipe 14 or frame of gas burning ignitor 10. Four jet nozzles 42, each about 0.030 inch diameter by $\frac{1}{8}$ inch long, equi-angularly space around the concentric axis of distribution head 40 on about a half-inch diameter pitch circle. The inlets to nozzles 42 are in fluid communication with gas supply pipe 18. Gas jets 45 emanate from the outlets of nozzles 42 and direct about a central core 49 which lies in roughly parallel relation to the axis of cylindrical gas distribution head 40. A stem 60 welds to the center of distribution head 40 and extends along the core 49 therefrom. A cylindrical chamber 43 for mixing aspirated air from the ignitor head 26 with gas from the distribution head 40 in combustible proportions has an internal diameter of about 1 inch and is in flow communication with and extends about $1\frac{3}{4}$ inches from the gas distribution head 40. Head 38 comprises a plurality of 1/16 inch diameter primary air ports 46 exposed to primary air from the ignitor head 26 and arranged in four rings spaced about 3/16 inch apart on the diagonal in the wall of chamber 43. Ports 46 are circumferentially spaced equally about the mixing chamber 43 and directed radially inward adjacent to the gas distribution head 40. A secondary combustion control shroud 44, also having an internal diameter of about 1 inch, mounts on and in concentric relation as an extension of mixing chamber 43 having a plurality of 1/16 inch diameter secondary ports 52 exposed to primary air and gas from the ignitor head 26 and arranged in four rings spaced about 3/16 inch apart on the diagonal in the wall of shroud 44. Ports 52 are circumferentially spaced equally about the combustion control shroud 44 and directed radially inward adjacent to the open end 54 of the same.

Figure 5:
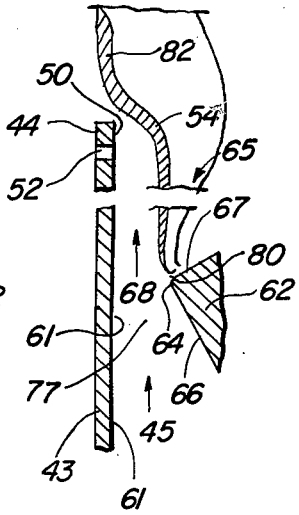
FIG. 5 shows a blow-up of a fragmented cross-section of the flame retention and stabilizing device in said pilot for gas burning ignitor of FIGS. 1–4.

Referring to FIGS. 3, 4 and 5, annular flame retainer and stabilizer 65 of pilot 38 comprises a stem 60 having a diameter of approximately 3/16 inch. Stem 60 weldedly engages one end of the center of gas distribution head 40 of gas burner ignitor frame 14 and extends in concentric relation with cylindrical mixing chamber 43 thereabout along the core of the gas jets 45 therein. An annular converging inlet 45 to stabilizer 65 comprises an external right frusto-conical surface 66 mounting its small end thereof to the other end of equal-diameter stem 60 in central location within said cylindrical wall 61 of mixing chamber 43. A diffusing outlet 68 from the stabilizer 65 comprises an external right conical surface 67 mounted back-to-back on the frusto-conical surface 66 in central location within said cylindrical wall 50 of shroud 44. A circumferential lip 64 on a heat sink 62 within the back-to-back frusto-conical surface 66/67 centrally mounts at the juncture of the frusto-conical surface 66 and conical surface 67 in line with gas jets 45 from nozzles 42 about the axis of the mixing chamber 43 along the length of the same at the center of aperture 56 for access of high-voltage electrode 39 through the wall of shroud 44. A restricted mixture flow area 77 is spaced between inner lip 64 and outer cylindrical wall 61 of mixing chamber 43.

Figure 6:
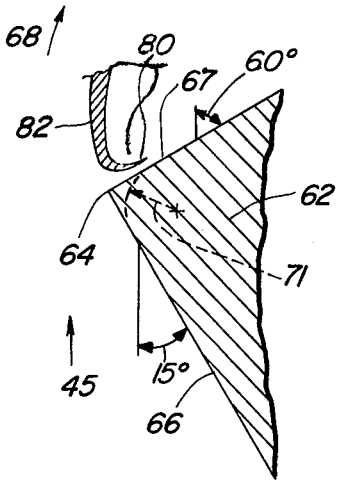
FIG. 6 shows a highly enlarged blow-up of a fragmented local cross-section of the lip of FIG. 5.

Referring to FIG. 6, the convergent inlet 66 to restricted area 77 mounts on heat sink 62 between stem 60 and lip 64 having an angle with respect to the axis of the mixing chamber 43 for operability ranging from plus (+) 10 to plus (+) 20 degrees with plus (+) 15 degrees as the optimum design criterion. Diffuser outlet 68 to restricted area 77 also mounts on heat sink 62 on the downstream side of lip 64 having an angle of divergence with respect to the axis of shroud 44 for operability ranging from minus (−) 50 minus (−) 70 degrees with minus (−) 60 degrees as the optimum design criterion. Lip 64 at restricted area 77 has a sharpness radius 71 for operability ranging from almost zero to 3/64 inch with 1/64 inch as the optimum design criterion.

Figure 8:
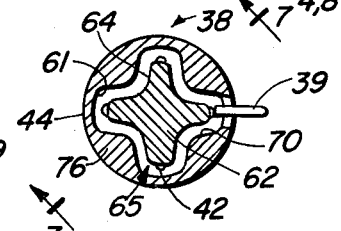
FIG. 8 shows an end view of a convoluted pilot.
Figure 7:
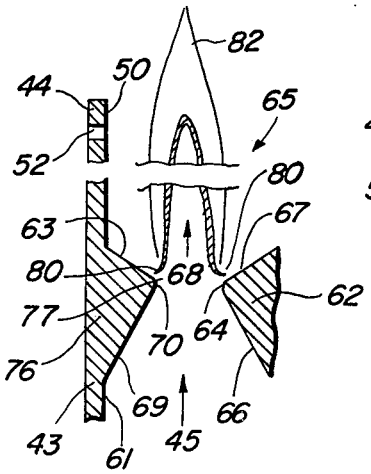
FIG. 7 shows a blow-up of a fragmented local cross-section of a similar conically convergent-divergent inlet/diffuser pilot.

Referring to FIGS. 7 and 8, restricted flow area 77 has a convoluted form and an outer lip 70 spaces from inner lip 64 at restricted area 77 and mounts on heat sink 76 which is in heat conduction relation with the wall of mixing chamber 43. Convergent inlet 69 to restricted area 77 mounts on heat sink 76 and diffuser outlet 63 mounts on the same on opposite side of lip 70 inbetween.

Referring to FIGS. 1 and 3, an electrode extension 39 mounts one end to the other end of electrical conduction 20 in carrier pipe 14 which extends beyond end support and air distribution control legs 17 of carrier pipe 14 and traverses through aperture 56 in the wall of shroud 44 to within spaced electrical discharge relation with lip 64.

In the operation of the gas/electric pilot 38, as shown in FIG. 1, primary combustion gas at up to 10 psig is first introduced down supply pipe 18 depending upon whether propane or natural gas is burned and the heat production capacity desired. Primary combustion air at 100 psi is then supplied to the carrier pipe 14 through connection 84 and throttled by or from openings 27 of shroud 25 when no compressed air from connection 84 is used. Electrode 20 is then energized to ignite the flame edge 80 at the lip 64, as shown in FIG. 6, at the restricted flow area 77 opposite the end of mixing chamber 43 from nozzles 42 in gas distribution head 40. Flame edge 80 spreads around lip 64 and further ignites flame 82 in mixture which has been mixed in the chamber 43 by the turbulizing gas jets from nozzles 42 and the aspirated air from ports 46 in said chamber, and flow-stabilized at lip 64 by the convergence 66 of the inlet to restricted flow area 77.

Stabilization of the flame begins at the flame edge 80 near the lip 64, as shown in FIG. 6, where both the gas/air mixture velocity and the normal velocity of combustion products approach zero because of the geometry of sharp lip 64 and the chill from the presence of the heat sink 62. The remainder of the flame 82 in the pilot is ignited by this edge 80 and is further stabilized relative to this edge by changes in the burning surface due to disturbances in combustion at the flame front resulting in one element of the burning zone furnishing a greater or lesser volume of fresh gas/air mixture with heat. Stable flames are also obtained by diffusion of chain-branching "free" chemical radicals from the fresh mixture edge of the flame 80 at the lip 64 in the same manner as heat chill is transferred. Diffuser outlet 68 to restricted area 77 decelerates the gas/air mixture flowing therefrom and further stabilizes the remainder of said flame 82 relative to the stabilized edge 80 of the same adjacent to the lip 64.

Capacity of pilot 38 is approximately 30,000 btu/hr. Another reason why the pilot 38 is stable over a wide range of ignitor 10 heat capacities from 1 to 2 million btu/hr. is that the air required to make a combustible fuel/air mixture ratio is carbureted out of the aspiration ports 46 in the wall of mixing chamber 43 adjacent to the efflux of gas from nozzles 42 in gas distribution head 40 to maintain a mixture ratio of combustible proportions for the range of heat capacities stated.

Although but three preferred embodiments have been herein shown and described, it will be understood that details of the construction shown may be altered or omitted without departing from the spirit of the invention as defined by the following claims.

I claim:

1. A pilot for gas burning ignitors comprising:
(a) sources of pressurized gas and primary and secondary air;
(b) an elongated chamber having aspiration ports in the wall of the same in fluid communication with the source of primary air for mixing said air with gas;
(c) a gas jet means mounted on one end of the chamber in fluid communication therewith and with the source of pressurized gas;
(d) a gas/air mixture flow accelerating and decelerating means mounted on and in fluid communication with the other end of said mixing chamber having a lip means exposed therebetween to the flow of mixture therethrough and in heat conduction relation with a heat sink mounted thereby;
(e) an electric discharge means mounted adjacent to the lip means for igniting the combustible mixture of primary air and gas; and
(f) an elongated shroud mounted on and in fluid communication at one end with the other end of said mixing chamber and having aspiration ports in the wall of the same in fluid communication with the source of secondary air for controlling the secondary combustion therein.

2. A pilot as set forth in claim 1 wherein the elongated mixing chamber comprises a cylindrical tube having a plurality of radially-directed air aspiration ports in circumferential array adjacent to the one end thereof.

3. A pilot as set forth in claim 1 wherein the gas jet means comprises a gas distribution head mounting a plurality of nozzles in circular array and directed parallel to an axis through the center of the same.

4. A pilot as set forth in claim 1 wherein the flow accelerating and decelerating means comprises:
(a) a restriction area having a convergent annular inlet for accelerating the flow of mixture from the mixing chamber; and
(b) a divergent annular outlet therefrom for decelerating the flow of mixture from said restriction area.

5. A pilot as set forth in claim 1 wherein the lip means comprises a restriction area bounded by radii in the range of 0 to 3/64 inch.

6. A pilot as set forth in claim 1 wherein the elongated shroud comprises a cylindrical tube having a plurality of radially-directed air aspiration ports in circumferential array adjacent to the other end thereof.

7. A pilot as set forth in claim 4 wherein the flow accelerating means comprises an annularly convergent inlet having a cylindrical outer periphery spaced radially from a conical inner surface at an angle relative to the axis thereof ranging from 10 to 20 degrees.

8. A pilot as set forth in claim 4 wherein the flow decelerating means comprises an annularly divergent outlet having a cylindrical outer periphery spaced radially from a conical inner surface at an angle relative to the axis thereof ranging from 50 to 70 degrees.

9. A pilot for gas burning ignitors comprising:
(a) a jet means source of pressurized gas and sources of primary and secondary air;
(b) a tubular chamber means having its inlet at one end mounted on and in fluid communication with the gas jet means and aspiration ports in the wall of the same in fluid communication with the source of primary air for mixing the same therein in combustible proportions;
(c) a combustible mixture flow accelerating and decelerating means having its inlet mounted on and in fluid communication with the outlet at the other end of said chamber means and a peripheral lip means exposed to the combustible mixture in heat conduction relation with a heat sink means inbetween;
(d) an electric discharge means mounted adjacent to the lip means for igniting the combustible mixture of gas and primary air; and
(e) a tubular shroud means having its inlet at one end mounted on and in fluid communication with the outlet of said combustible mixture flow accelerating and decelerating means and aspiration ports in the wall of the same in fluid communication with the source of secondary air for controlling the secondary combustion therein from said pilot.

10. A pilot for gas burning ignitors comprising:
(a) sources of pressurized gas and primary and secondary air;
(b) an elongated mixing chamber having primary air inlet means in the wall of the same in fluid communication with the source of primary air for mixing air with gas in combustible proportions;
(c) a gas jet means mounted on one end of the chamber in fluid communication with the interior thereof and with the source of pressurized gas;
(d) gas/air mixture flow accelerating means mounted in fluid communication with combustible flow decelerating means and with the other end of said mixing chamber having a gas/air mixture chilling lip means exposed to the flow of mixture therebetween in heat conduction relation with a heat sink mounted thereby;
(e) an electric discharge means mounted adjacent to the lip means for igniting the mixture of primary air and gas; and
(f) an elongated open-ended shroud mounted on and in fluid communication at its other end with the other end of said mixing chamber having secondary air inlet means in the wall of the same in fluid communication with the source of secondary air for controlling the secondary combustion therein.

11. A pilot as set forth in claim 10 wherein the elongated mixing chamber having primary air inlet means comprises a cylindrical tube having a plurality of radially-directed aspiration ports in circumferential array adjacent to the one end thereof.

12. A pilot as set forth in claim 11 wherein the gas jet means comprises a gas distribution head mounting a plurality of nozzles arranged in array about and radially spaced from and directed in approximate parallel relation to the center axis of the same at the lip means on the other end of the mixing chamber.

13. A pilot as set forth in claim 10 wherein the flow accelerating and decelerating means comprises a restricted flow area having a convergent annular gas/air mixture flow inlet thereto and a divergent annular combustible flow outlet therefrom.

14. A pilot as set forth in claim 13 wherein the gas/air mixture chilling lip means comprises a sharp convex surface exposed to the flow of gas/air mixture at the flow restricted area.

15. A pilot as set forth in claim 10 wherein the elongated open-ended shroud having secondary air inlet means comprises a cylindrical tube having a plurality of radially-directed aspiration ports in circumferential array adjacent to its open end thereof.

16. A pilot as set forth in claim 14 wherein the sharpness of said convex lip surface comprises radii in the range of 0 to 3/16 inch.

17. A pilot as set forth in claim 13 wherein the annularly convergent inlet thereto comprises an outer cylindrical surface spaced radially from a concentric inner conical surface angled relative to the axis thereof ranging from plus (+) 10 to plus (+) 20 degrees.

18. A pilot as set forth in claim 13 wherein the annularly divergent outlet therefrom comprises an outer cylindrical surface spaced radially from a concentric inner conical surface angled relative to the axis thereof ranging from minus (−) 50 to minus (−) 70 degrees.

19. A pilot for gas burning ignitors having sources of pressurized gas and of primary and secondary air comprising:

(a) a tubular gas/air mixing chamber having inlet and outlet ends mounting a gas distribution head in fluid communication with said pressurized gas at the inlet thereof;

(b) a gas/air mixture flow accelerator section mounting on and in fluid communication with the outlet end of said tubular mixing chamber having an outer cylindrical surface spaced radially out from a convergent, concentric inner conical surface angled relative to the axis thereof ranging from approximately a plus (+) 10 to plus (+) 20 degrees;

(c) a gas/air mixture chilling lip section mounting on and in fluid communication with the outlet of said flow accelerator section having a circumferential convex surface spaced radially inward from the concentric outer cylindrical surface and a sharpness radius ranging from approximately 0 to 3/64 inches;

(d) a plurality of gas jet nozzles mounting in said gas distribution head in circumferential array radially spaced from and directed in roughly parallel relation to the axis of the tubular mixing chamber at the lip between the flow accelerator and decelerator sections;

(e) a plurality of primary air aspiration ports in the wall of the tubular mixing chamber adjacent to the outlets of said nozzles in fluid communication with the source of primary air;

(f) a combustible flow decelerator section mounting on and in fluid communication with the outlet of said circumferential gas/air mixture chilling lip section having an outer cylindrical surface spaced radially out from a divergent concentric inner conical surface angled relative to the axis thereof ranging from approximately a minus (−) 50 to minus (−) 70 degrees;

(g) an electrode mounting on said tubular mixing chamber in electric discharge relation with and adjacent to the gas/air mixture chilling lip section therein, extending through apertures in both the outer cylindrical accelerator-decelerator surfaces thereof; and (f) an open-end tubular combustible shroud having an inlet mounting on and in fluid communication with the outlet of the tubular gas/air mixing chamber and a plurality of secondary air aspiration ports in the wall thereof adjacent to the open end of the same.

* * * * *